US008281771B2

(12) United States Patent
Lim et al.

(10) Patent No.: US 8,281,771 B2
(45) Date of Patent: Oct. 9, 2012

(54) EXHAUST GAS RECIRCULATION VALVE IN VEHICLE

(75) Inventors: Chang Sik Lim, Jincheon-gun (KR); Ki Ho Jung, Jincheon-gun (KR); Yong Soo Jang, Jincheon-gun (KR); In Suk Choi, Jincheon-gun (KR); Dong Wook Choi, Jincheon-gun (KR); Myeong Jae Lee, Jincheon-gun (KR)

(73) Assignee: Kamtec Inc., Iwol-Myeon (KR)

( * ) Notice: Subject to any disclaimer, the term of this patent is extended or adjusted under 35 U.S.C. 154(b) by 438 days.

(21) Appl. No.: 12/706,223

(22) Filed: Feb. 16, 2010

(65) Prior Publication Data

US 2011/0197863 A1 Aug. 18, 2011

(51) Int. Cl.
*F02B 47/08* (2006.01)
*F02B 47/10* (2006.01)

(52) U.S. Cl. ..... 123/568.23; 123/568.21

(58) Field of Classification Search ..... 123/568.2, 123/568.21, 568.23, 568.24, 568.26; 701/108
See application file for complete search history.

(56) References Cited

U.S. PATENT DOCUMENTS

| | | | | |
|---|---|---|---|---|
| 4,840,350 | A | 6/1989 | Cook | |
| 6,039,034 | A * | 3/2000 | Field et al. | 123/568.23 |
| 6,443,135 | B1 * | 9/2002 | Dismon et al. | 123/568.18 |
| 7,013,880 | B2 * | 3/2006 | Watanuki et al. | 123/568.2 |

FOREIGN PATENT DOCUMENTS

| | | | |
|---|---|---|---|
| EP | 1 028 249 | A2 | 8/2000 |
| EP | 1 275 838 | A1 | 1/2003 |
| EP | 1 647 698 | A2 | 4/2006 |
| EP | 1 882 843 | A2 | 1/2008 |
| KR | 2009-0106840 | A | 12/2009 |
| WO | 2006-095087 | A1 | 9/2006 |
| WO | 2009-126615 | A2 | 10/2009 |

OTHER PUBLICATIONS

European Search Report dated Jun. 30, 2010 as received in related application No. EP 10153722.3.

* cited by examiner

*Primary Examiner* — Mahmoud Gimie
(74) *Attorney, Agent, or Firm* — Maschoff Gilmore & Israelsen

(57) ABSTRACT

An exhaust gas recirculation valve in a vehicle has two valves that are controlled individually by using one driving source. The exhaust gas recirculation valve enables secure operation of a vehicle even if the driving source is out of order. The exhaust gas recirculation EGR valve includes a driving unit having a driving motor for rotating a motor shaft and an interlocking unit for receiving rotational force from the motor shaft. A rod portion moves upon reception of the rotational force. A valve unit at an end portion of the rod portion controls a flow rate of the exhaust gas. A valve housing is coupled to the driving unit as one unit and has an EGR port and a bypass port. The interlocking unit includes a valve return member for rotating the motor shaft forcibly to make the valve unit to move to an initial position.

12 Claims, 18 Drawing Sheets

EXHAUST GAS RECIRCULATION VALVE IN VEHICLE

BACKGROUND OF THE DISCLOSURE

1. Field of the Disclosure

The present invention relates to an exhaust gas recirculation valve in a vehicle.

2. Discussion of the Related Art

In general, the vehicle uses an exhaust gas recirculation unit for recirculating a portion of the exhaust gas to an engine for suppressing production of nitrogen oxide (NOx).

Since a related art exhaust gas recirculation (EGR) unit has an EGR valve and a bypass valve provided and mounted to a vehicle body separately, there has been a problem in that controlling of respective valve is difficult.

Moreover, since the bypass valve requires a separate pneumatic pipeline for operation and, has difficulty in making stable control of an amount of the exhaust gas, an early countermeasure on this has been required.

SUMMARY OF THE DISCLOSURE

Accordingly, the present invention is directed to an exhaust gas recirculation valve in a vehicle.

An object of the present invention is to provide an exhaust gas recirculation valve in a vehicle, in which an EGR port and a bypass port are unified into one valve.

Another object of the present invention is to provide an exhaust gas recirculation valve in a vehicle, in which a single driving unit can make a linear control of two valves (an EGR valve and a bypass valve).

Another object of the present invention is to provide an exhaust gas recirculation valve in a vehicle, in which an EGR valve returns to an initial position automatically when the EGR valve is out of order.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an exhaust gas recirculation valve in a vehicle includes a driving unit having a driving motor for rotating a motor shaft, an interlocking unit for receiving rotation force from the motor shaft, a rod portion arranged perpendicular to the interlocking unit for moving upon reception of the rotation force from the interlocking unit, a valve unit provided to an end portion of the rod portion for controlling a flow rate of the exhaust gas, and a valve housing coupled to the driving unit as one unit, having an EGR port and a bypass port, wherein the interlocking unit includes a valve return member for rotating the motor shaft forcibly to make the valve unit to move to an initial position.

The valve return member is a torsion spring which generates torsion in a rotation direction of a regular or reverse direction rotation of the motor shaft.

The torsion spring includes a body portion having a coil wound plurality of times, and first and second extensions from a starting point and an end point of the coil wound thus, respectively.

The interlocking unit further includes a cap member which covers an outside, and the valve return member is mounted in the cap member.

The cap member includes a projection from an inside surface thereof.

The projection includes a guide projection for supporting the first and second extensions of the torsion spring, and a stopper arranged spaced from the guide projection.

The interlocking unit further includes an interlocking gear for rotating the valve return member in a circumference direction interlocked with rotation of the motor.

The interlocking gear has magnets arranged in a section of a circumferential surface thereof.

The valve housing includes a passage having a vertical opening for enabling the valve unit to move up/down, an exhaust gas inlet arranged to cross the passage perpendicular to a direction of the opening for introduction of the exhaust gas therethrough, and an exhaust gas outlet arranged on the same line with the exhaust gas inlet, wherein the exhaust gas outlet has an EGR port of an enlarger arranged thereto, which has a diameter that becomes the greater as the exhaust gas outlet goes to an outside the more, and a bypass port which is partitioned from the EGR port and an outward extension having the same diameter.

The valve housing includes valve seats provided at positions where the exhaust gas inlet and the exhaust gas outlet cross with the passage for guiding movement of the valve unit, respectively.

The valve unit includes one pair of valve plates fixedly secured to an end portion of the rod portion opposite to each other, and springs arranged between the valve plates.

The EGR valve further includes a control unit arranged adjacent to the driving unit for supplying power to, and controlling operation of, the driving unit, and receives rpm of the engine, a torque state, an exhaust gas temperature, and a cooling water temperature for controlling the driving unit.

The control unit includes a sensor unit for sensing magnetic flux density of magnets provided to the interlocking gear when the motor shaft rotates.

The EGR valve further includes a gasket between the driving unit and the valve housing for cutting off conduction of the high temperature exhaust gas and heat to the control unit.

The EGR valve further includes a heat discharge unit between the driving unit and the valve housing through which the cooling water flows for preventing heat of the high temperature exhaust gas from transmitting to the control unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIGS. 17~9 illustrate operation states in which an exhaust gas flow and a signal flow are shown in an EGR valve in a vehicle in accordance with a preferred embodiment of the present invention, respectively.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
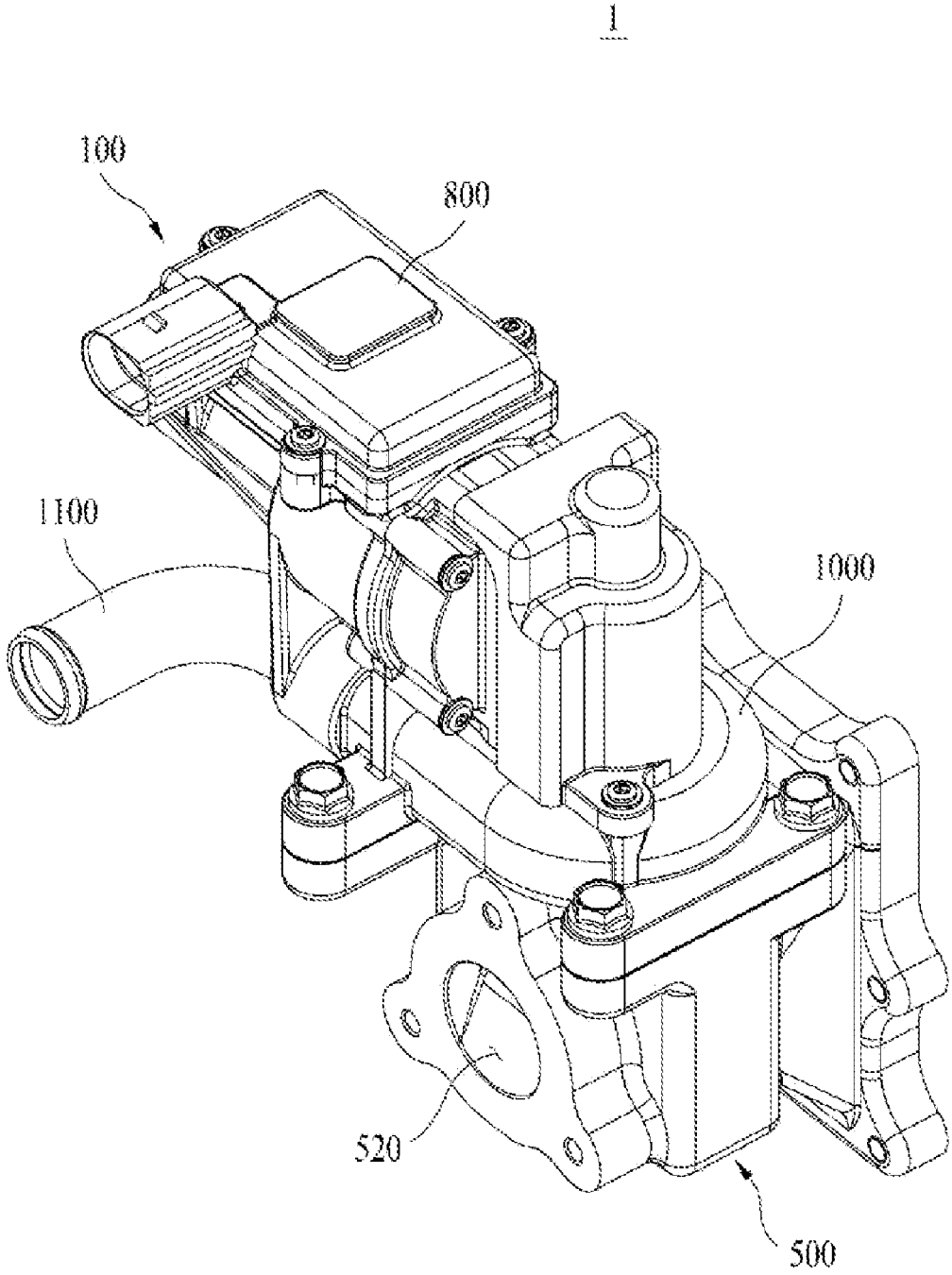
FIG. 1 illustrates a perspective view of an exhaust gas recirculation valve in a vehicle in accordance with a preferred embodiment of the present invention.

Referring to FIG. 1, the EGR (Exhaust Gas Recirculation) valve 1 includes a valve housing 500 having an EGR port and a bypass port provided thereto for pass through of the exhaust gas. The EGR port and the bypass port will be described in detail, later.

The valve housing 500 has a driving unit 100 arranged thereon. The driving unit 100 has a control unit 800 and a socket provided on an upper side, separately.

Between the valve housing 500 and the driving unit 100, there is a heat discharge unit 1000 mounted thereto for preventing the driving unit 100 and the control unit 800 from malfunctioning and burning due to a high temperature of the exhaust gas.

Figure 9:
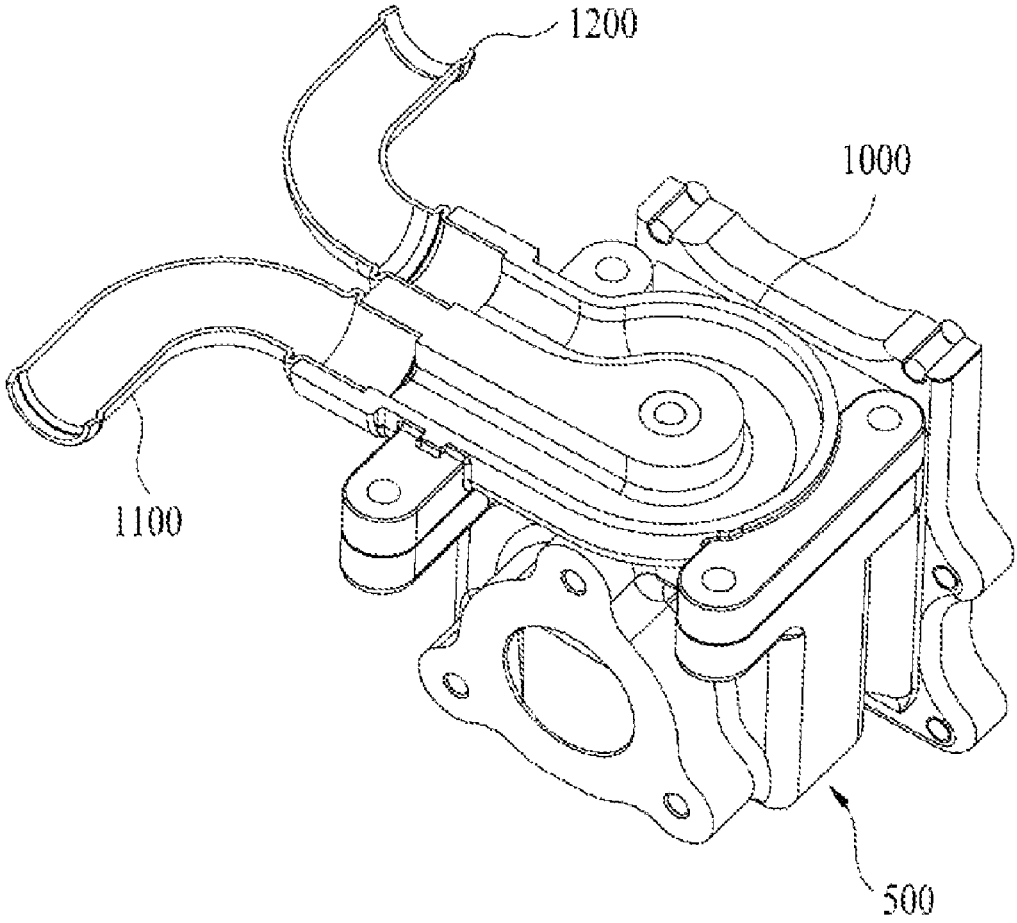
FIG. 9 illustrates a perspective view of a heat discharge unit in an EGR valve in a vehicle in accordance with a preferred embodiment of the present invention.

The heat discharge unit 1000 has an inlet pipe 1100 and an outlet pipe 1200 connected thereto for supply of cooling water (See FIG. 9). The heat discharge unit 1000 will be described, later.

A configuration of the EGR valve in accordance with another preferred embodiment of the present invention will be described with reference to the attached drawing.

Figure 2:
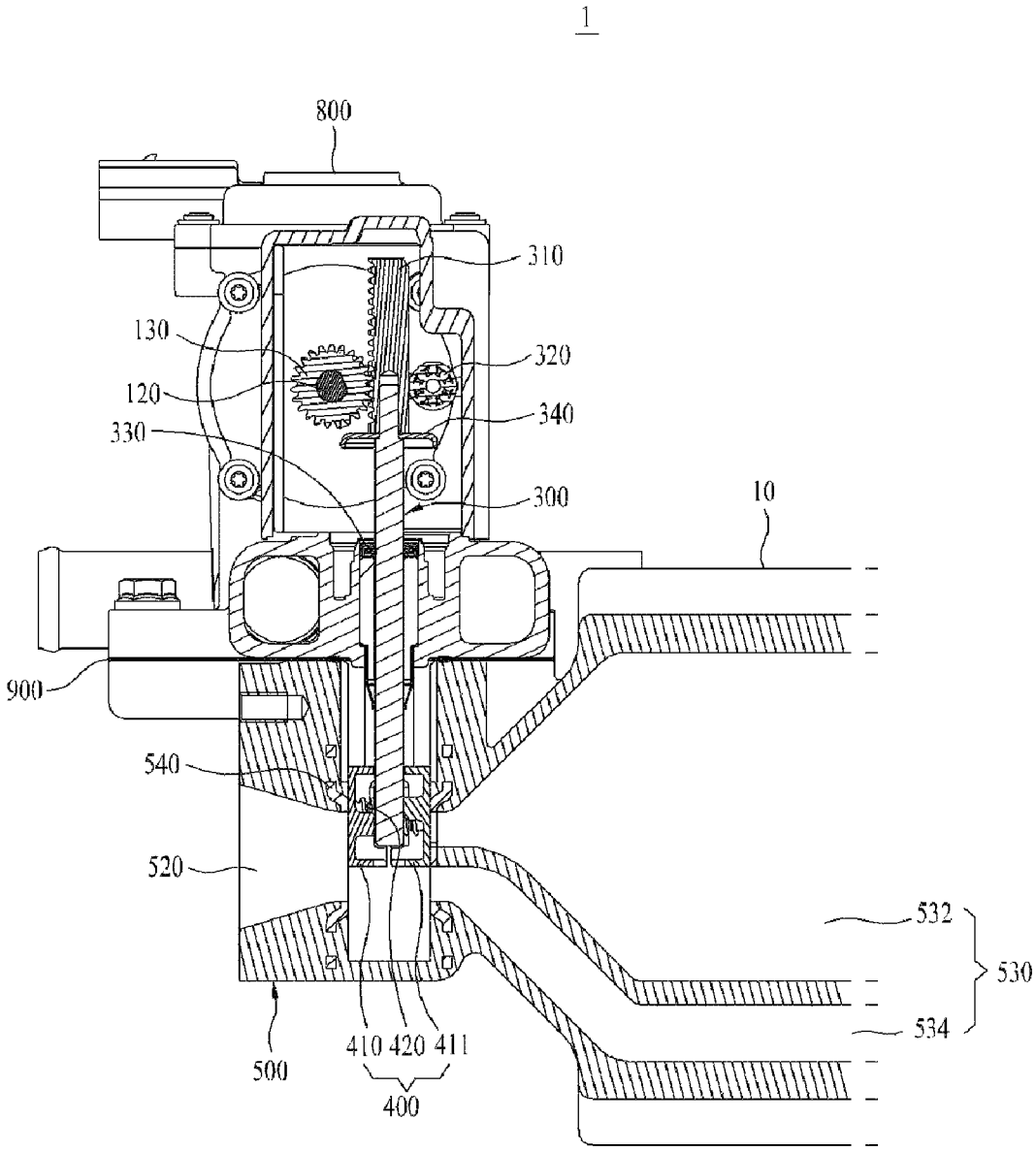
FIG. 2 illustrates a longitudinal section of an exhaust gas recirculation valve in a vehicle in accordance with a preferred embodiment of the present invention.

Referring to FIG. 2, the EGR valve has a basic configuration is similar to FIG. 1, but includes a gasket 900 mounted between the valve housing 500 and the driving unit 100 for preventing the control unit 800 from malfunctioning and burning due to the high temperature of the exhaust gas.

The gasket 900 is formed of 0.5 mm thick steel. Both the heat discharge unit 1000 and the gasket 900 may be mounted.

The driving unit will be described with reference to the attached drawings.

Figure 3:
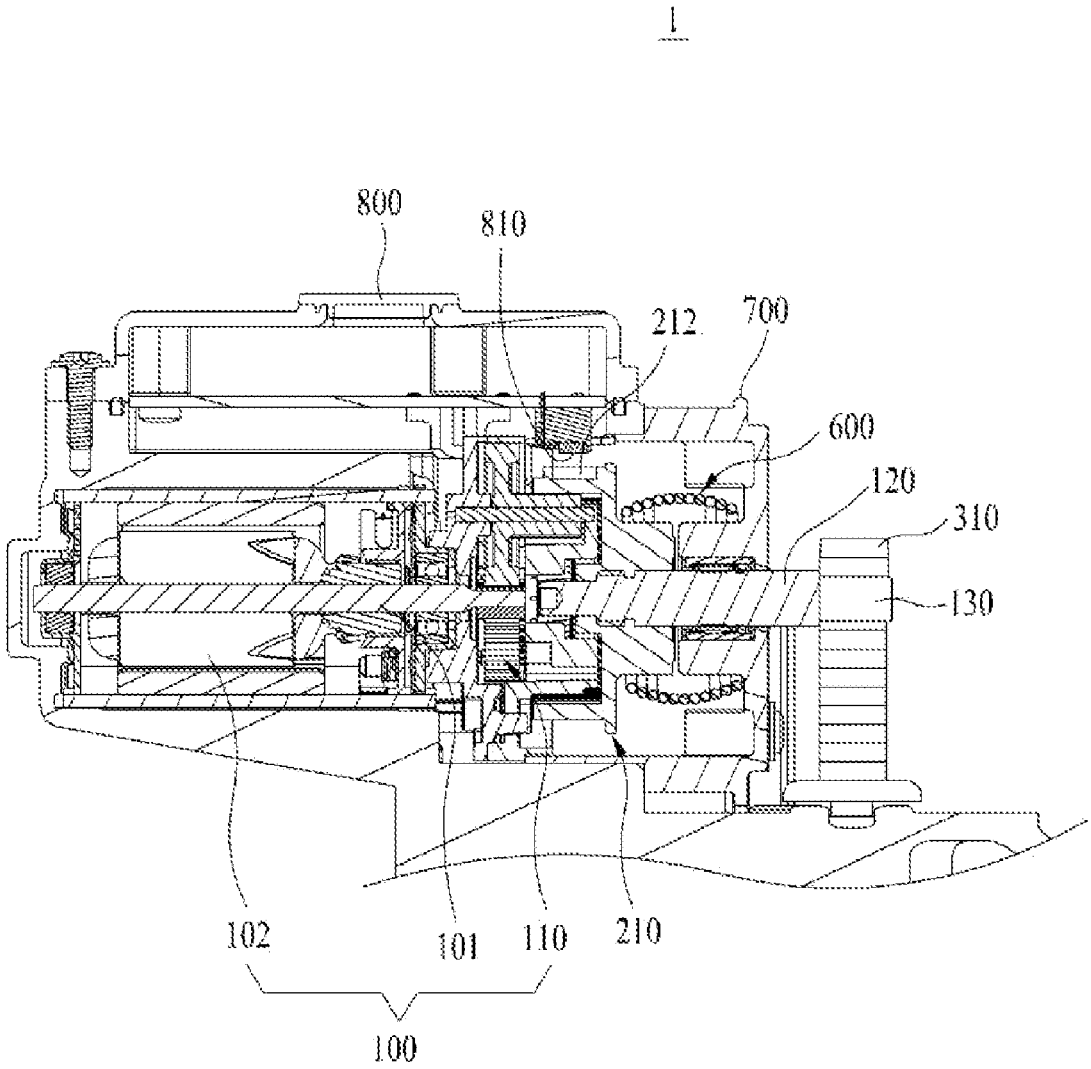
FIG. 3 illustrates a section of an exhaust gas recirculation valve in a vehicle in accordance with a preferred embodiment of the present invention, partially.
Figure 4:
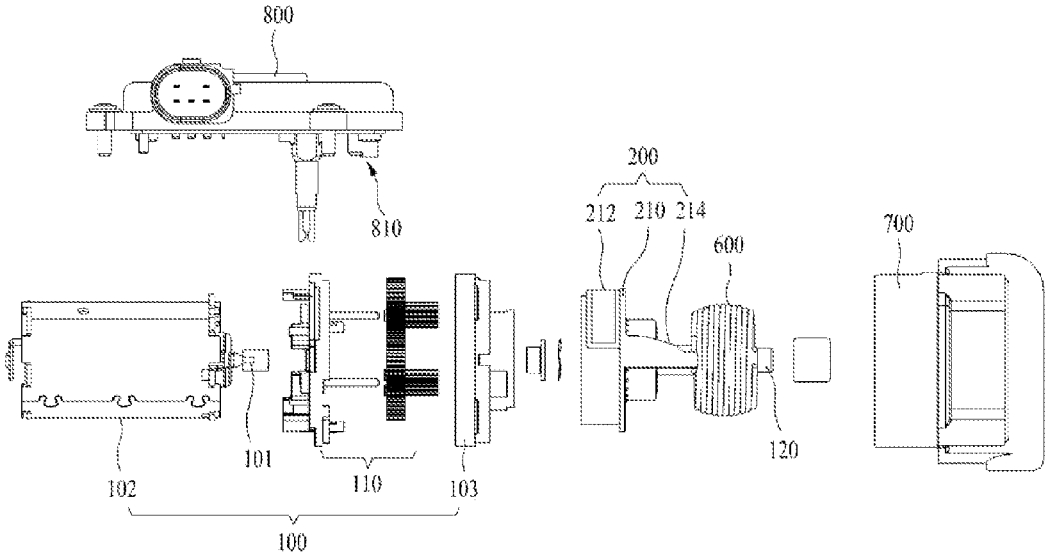
FIG. 4 illustrates an exploded view of a control unit, a driving unit, and an interlocking unit of an exhaust gas recirculation valve in a vehicle in accordance with a preferred embodiment of the present invention, for showing joining relations.
Figure 5:
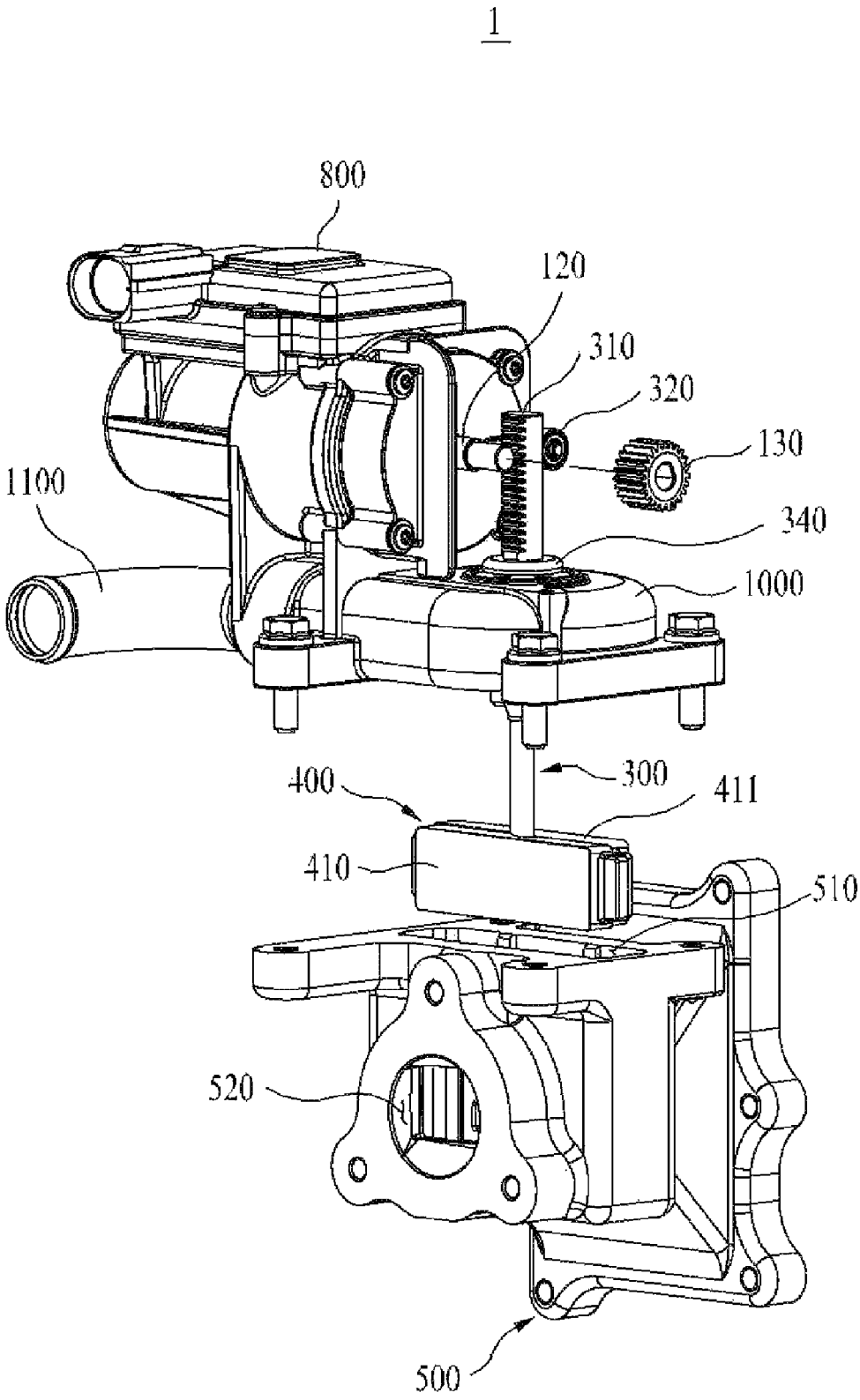
FIG. 5 illustrates a perspective view of an exhaust gas recirculation valve in a vehicle in accordance with a preferred embodiment of the present invention, disassembled partially.

Referring to FIGS. 3 to 5, the driving unit 100 is mounted in a housing provided, separately. The driving unit 100 includes a driving motor 102, a gear unit 110, and a connection shaft 120 arranged on a line.

The driving motor 102 has a motor shaft 101 with a first spur gear 102 mounted thereto. The first spur gear 102 engages with a gear in the gear unit 110. The gear unit 110 is a speed changing gear for increasing a driving force from the driving motor 102, and a planetary gear may be used.

The gear unit 110 is mounted in a gear housing 103.

The gear unit 110 is connected to a connection shaft 120, and the connection shaft 120 is extended toward a rod portion 300 via an interlocking gear 210 and a cap member 700 in the interlocking unit.

The connection shaft 120 has a second spur gear 130 coupled to an outer end, and the second spur gear 130 engages with a rack gear 310.

A valve return member 600 is mounted in the cap member 700, and will be described, later.

The rod portion and the valve housing in the EGR valve of the present invention will be described with reference to the attached drawing.

Referring to FIG. 5, the rack gear coupled to the rod portion 300 engages with the second spur gear 130 coupled to the connection shaft 120 for transmission of power.

The rack gear 310 is arranged perpendicular to the second spur gear 130 for moving up/down the valve unit 400 with the driving power of the driving motor 102.

The rack gear 310 is provided with a support bearing mounted to a back side of rack teeth for maintaining a gap to be formed when the rack gear 310 moves up/down. That is, the support bearing 320 is arranged for preventing the rack gear 310 from moving in left/right directions.

The rack gear 310 has the rod portion 300 coupled to an underside thereof, and the rod portion 300 has a lower end coupled to the valve unit 400.

The rod portion 300 has a first sealing member 330 and a second sealing member 340 placed therein for preventing the exhaust gas from moving upward in a length direction of the rod portion 300.

The second sealing member 340 is placed in a position where the rack gear 310 couples to the rod portion 300, and the first sealing member 330 is placed under the second sealing member 340.

The first sealing member 330 is a kind of O-ring, provided for preventing the exhaust gas from infiltrating into the heat discharge unit 1000 or the driving unit 100 along the rod portion 300, for the first time.

The second sealing member 340 is provided for preventing the exhaust gas passed through the first sealing member 330 from moving any further. The valve unit will be described, later.

The valve housing 500 has a passage 510, a vertical opening, for enabling the valve unit 400 to move up/down. And, an exhaust gas inlet 520 is arranged to cross the passage 510 perpendicular to a direction of the opening for introduction of the exhaust gas therethrough, and an exhaust gas outlet 530 is arranged on the same line with the exhaust gas inlet 520.

The exhaust gas outlet 530 has an EGR port 532 of an enlarger arranged thereto, which has a diameter that becomes the greater as the exhaust gas outlet 530 goes to an outside the more, and a bypass port 534 which is an outward extension having the same diameter.

The EGR port 532 has an outside with an EGR cooler 10 connected and mounted thereto. The EGR cooler 10 is a kind of heat discharger for dropping a temperature of the exhaust gas before the exhaust gas is supplied to the engine.

The EGR port 532 is an enlarger for making secure heat discharge from the exhaust gas and easy connection to the EGR cooler 10.

The EGR port 532 is constructed of the enlarger for making adequate heat discharge at the EGR cooler 10 by dropping a speed of the exhaust gas by expanding the exhaust gas when the exhaust gas introduced to the EGR port 532 through the exhaust gas inlet 520 passes through the enlarger where a diameter thereof is enlarged.

At positions where the passage 510 crosses the exhaust gas inlet/outlet 520 and 530, valve seats 540 are provided for guiding movement of the valve unit 400.

The valve unit 400 is formed of stainless steel, and the valve housing 500 is formed of aluminum. Because the valve seat 540 is liable to worn down due to friction with the valve unit 400 if the valve seat 540 is formed of a material the same with the valve housing 500, it is preferable that the valve seat 540 is formed of stainless steel.

The valve unit 400 is coupled to the rod portion 300 as valve plates 410 and 411 thereof are in closely contact to the lower end of the valve unit 400.

Figure 6:
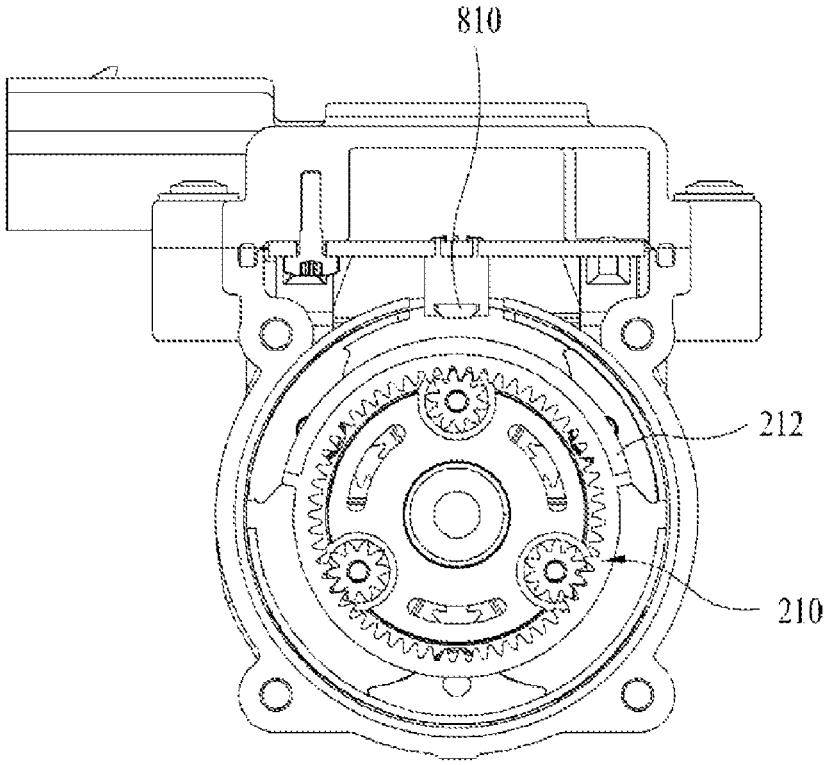
FIG. 6 illustrates a diagram showing configuration of a sensor unit and a magnet in an exhaust gas recirculation valve in a vehicle in accordance with a preferred embodiment of the present invention.

Referring to FIG. 6 attached hereto, the control unit 800 is arranged on an upper side of the driving unit 100, and includes a sensor unit 810 for sensing magnetic flux density of the magnets 212 provided to the interlocking gear 210.

The magnets 212 are arranged in a semi-circular shape, with N poles and S-poles in close contact. The sensor unit 810 uses a hole sensor, for sensing the magnetic flux density varied with position change of the interlocking gear and providing a signal to the control unit 800.

The valve return member and an interlocking gear in accordance with a preferred embodiment of the present invention will be described, with reference to the drawings.

Figure 7:
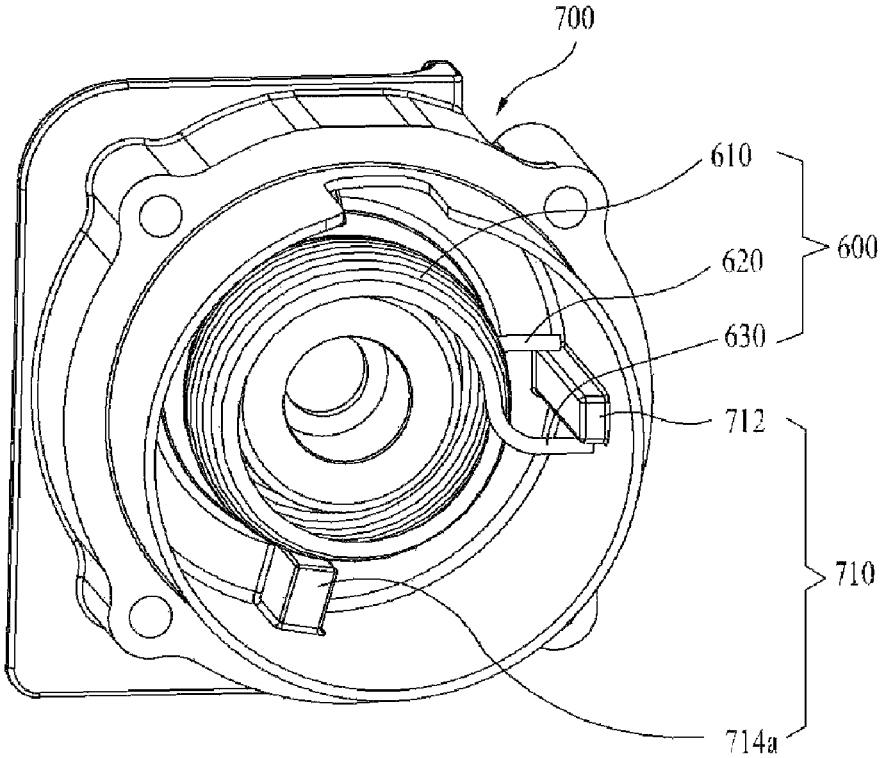
FIG. 7 illustrates a perspective view showing a state in which a valve return member is mounted to a cam member in an exhaust gas recirculation valve in a vehicle in accordance with a preferred embodiment of the present invention.
Figure 8:
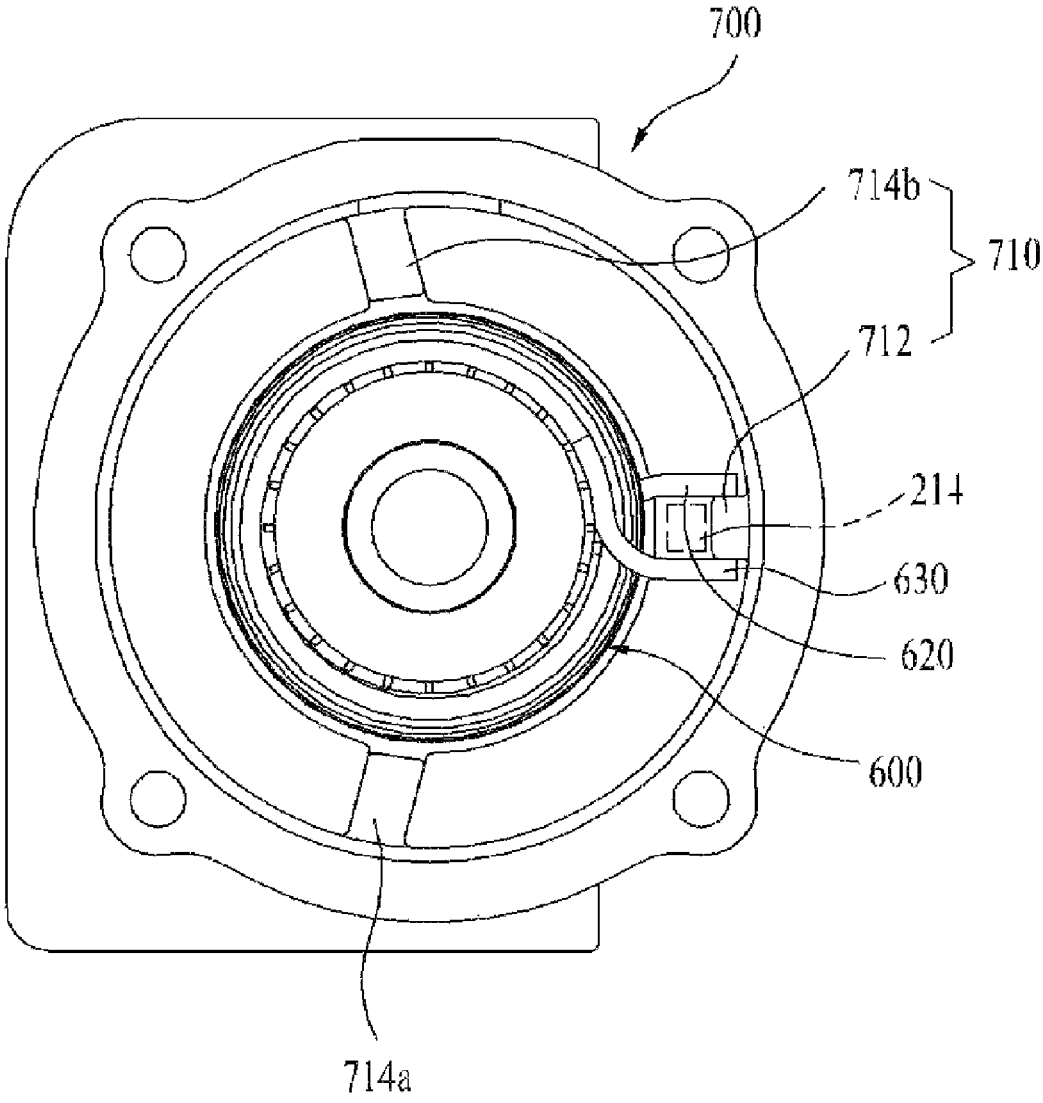
FIG. 8 illustrates a plan view showing a state in which a valve return member is mounted to a cam member in an exhaust gas recirculation valve in a vehicle in accordance with a preferred embodiment of the present invention.

Referring to FIGS. 7 and 8 attached hereto, the valve return member 600 is mounted in the cap member 700. Though the embodiment suggests that the valve return member 600 is a torsion spring which exerts torsion in opposite directions, it is apparent that the torsion spring can be replaced with other member that can exert torsion similar to the torsion spring.

The cap member 700 has an insert opening in a center for placing the torsion spring therein. The torsion spring includes a first extension 620 and a second extension 630 extended outward from a starting point and an end point of a coil, respectively.

The cap member 700 has guide projections 712 on an inside for holding the first and second extensions 620 and 630, respectively. The guide extensions 712 maintain an initial state when the first extension 620 or the second extension 630 is moved to a particular direction by a holding portion 214 of the interlocking gear 210.

Of the first and second extensions 620 and 630, one that is positioned over the holding portion 214 is the first extension 620, and the other one that is positioned under the holding portion 214 is the second extension 630.

Formed between the guide projection 712 and a body portion 610, there is a rectangular space for positioning the holding portion 214 of the interlocking gear 210.

At the time the torsion spring is mounted to the interlocking gear 210 in a state the torsion spring is placed in the cap member 700, the holding portion 214 is positioned in the space between the guide projection 712 and the body portion 610. The holding portion 214 is shown in a dashed line.

If the motor shaft rotates in a clockwise or counter clockwise direction by a predetermined angle, interlocked with the rotation of the motor shaft, the holding portion 214 rotates while pressing the first extension 620 or the second extension 630 in the direction of the rotation.

For an example, torsion generating as the first extension 620 is rotated in one direction by the holding portion 214 turns into elastic force at the body portion 610, and the second extension 630 maintains a state in which rotation of the second extension 630 is limited by the guide projection 712.

In this instance, since a torque generated by the driving motor is greater than the torsion generated as the torsion spring is twisted, the torsion spring does not return to an original position, but maintains the present state.

If an error takes place, in which the driving motor is out of order, or a power source is cut off, in a state the first extension 620 is rotated to one direction by the holding portion 214, the interlocking gear 210 is made to return to the original position by forcibly rotating the holding portion 214 to a position before the holding portion 214 is rotated by using the elastic force stored in the body portion 610 of the torsion spring.

Accordingly, the connection shaft coupled to the interlocking gear 210 is rotated forcibly, and the valve unit 400 coupled to the rod portion 300 is moved to an initial state (a state both the EGR port and the bypass port are closed).

The cap member 700 has stoppers 714*a* and 714*b* for preventing the interlocking gear from rotating excessively.

The heat discharge unit of the present invention will be described with reference to the drawings.

Referring to FIG. 9, the heat discharge unit 1000 has the inlet pipe 1100 and the outlet pipe 1200 connected thereto respectively, and is arranged on an upper side of the valve housing 500 so that cooling water introduced through the inlet pipe 1100 heat exchanges with a high temperature of the exhaust gas.

The cooling water heat exchanged with the exhaust gas thus is supplied to the radiator (not shown) through the outlet pipe 1200, and is supplied to the inlet pipe 1100 again after a temperature of the cooling water overheated thus is dropped.

The heat discharge unit 1000 has a moving path arranged to heat exchange as the cooling water flows along an upper side surface of the valve housing 500, and heat dissipation fins (not shown) may be attached to an outside of the heat discharge unit 1000 additionally for better heat discharge.

The valve unit of the present invention will be described with reference to the drawing attached hereto.

Figure 10:
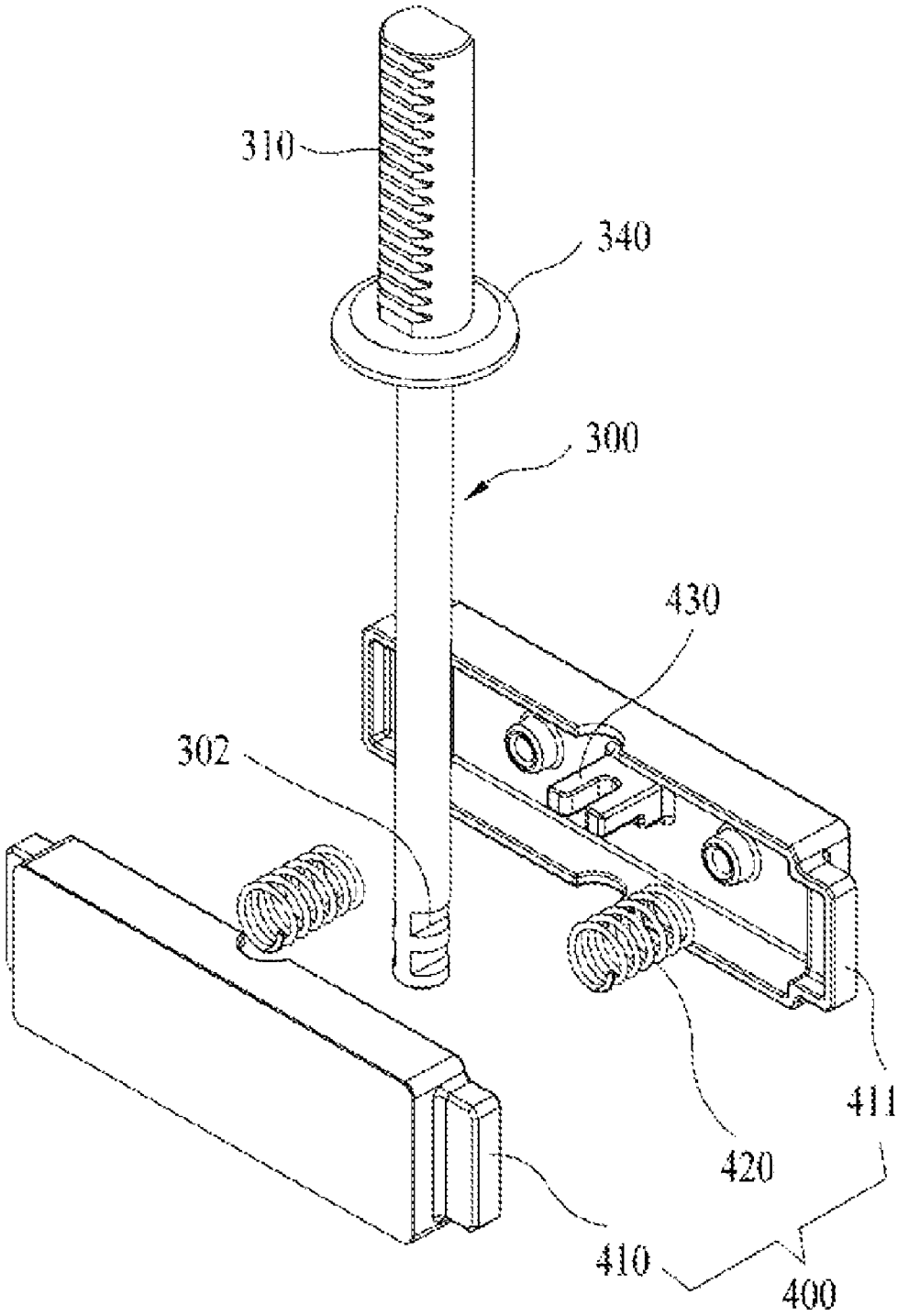
FIG. 10 illustrates a perspective view of a valve unit and a rod portion in an EGR valve in a vehicle in accordance with a preferred embodiment of the present invention.

Referring to FIG. 10, the valve unit 400 includes one pair of the valve plates 410 and 411 fixedly secured to the end portion of the rod portion 300 opposite to each other.

Between the valve plates 410 and 411, there are springs 420 provided thereto. A plurality of the springs 420 are provided along a length direction of the valve plates 410 and 411.

The valve plates 410 and 411 have a coupling portion 430 projected inward from an inside for coupling to the rod portion 300. The coupling portion 430 is configured to be fastened to one of recesses 302 in a lower end of the rod portion 300.

The springs 420 are mounted to make outward elastic supporting of the valve plates 410 and 411, respectively.

Because outsides of the valve plates 410 and 411 are required to be brought into close contact with the valve seats 540 as far as possible for preventing a gap from forming between the valve unit 400 and the valve seats 540, thereby preventing leakage of the exhaust gas.

For an example, even in a case a pressure of the exhaust gas is applied to the valve plate 410 to compress the springs 420 to form the gap between one of the valve seats 540 and the valve unit 400, a flow of the exhaust gas can be blocked by the other valve plate 411 that maintains a tight close state between the ERG port 532 and the bypass port 534.

Under the valve unit 400, there is a chamber for holding deposits, such as carbon particles which are foreign matters from the exhaust gas, formed at the time the valve plates 410 and 411 move up/down.

The deposits are held at the chamber temporarily and discharged following the ERG port 532 by a flow pressure of the exhaust gas.

And, even in a case the deposits are accumulated on the valve seats 540 as the valve plates 410 and 411 move, the accumulation of the deposits is prevented as the valve plates 410 and 411 scrape the deposits down the chamber.

The operation of the EGR valve in a vehicle of the present invention will be described with reference to the drawings attached hereto.

Figure 11:
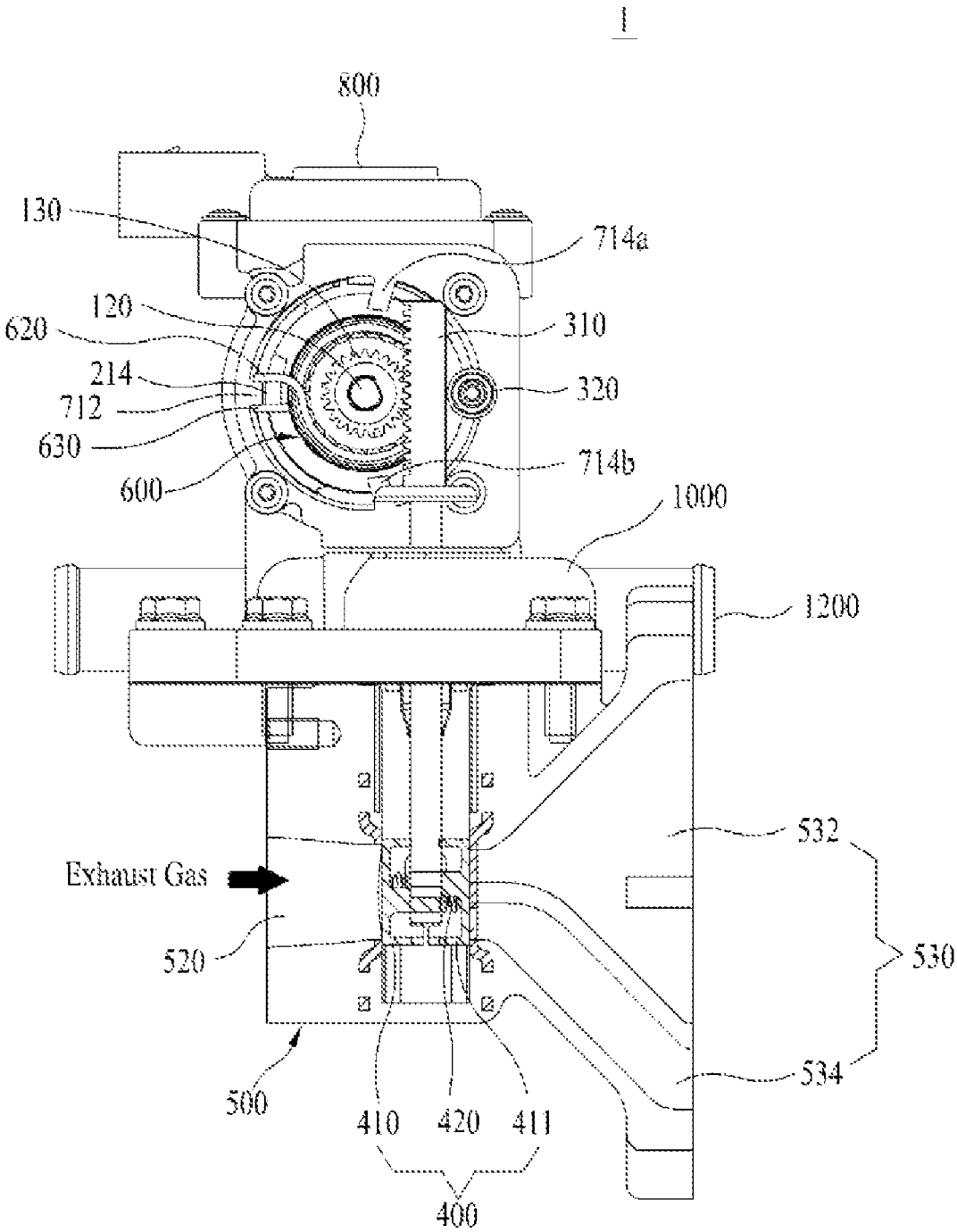
FIGS. 11~13 illustrate operation states of an EGR valve in a vehicle in accordance with a preferred embodiment of the present invention, respectively.

Referring to FIG. 11, the valve unit 400 is positioned (FIG. 11) in a state the valve unit 400 closes both the EGR port 532 and the bypass port 534 before the engine is put into operation. In this instance, the first and second extensions 620 and 630 of the valve return member 600 maintain fixed torsion while supported by the guide projection 712.

Figure 12:
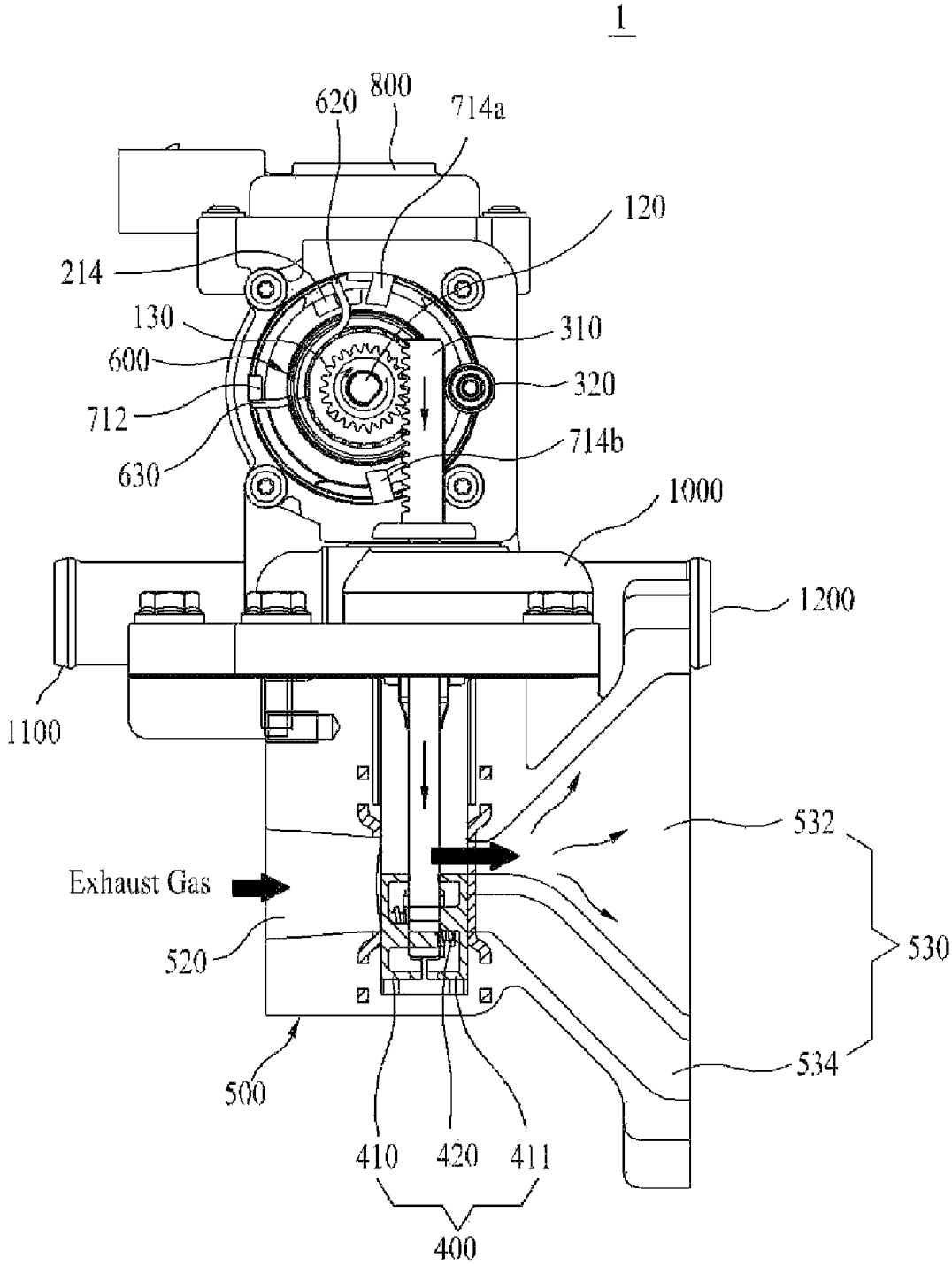

Referring to FIG. 12, if the vehicle starts, the exhaust gas produced from the engine (not shown) is introduced to the exhaust gas inlet 520 via an exhaust gas manifold.

Since a large amount of nitrogen oxide NOx is discharged at an initial running of the vehicle compared to a regular running, it is favorable to introduce the exhaust gas to the engine through the EGR port 532 to make combustion with fuel mixed with fresh air for suppressing the production of the nitrogen oxide.

For this, the control unit 800 provides a control signal to the driving motor 102 for rotating the motor shaft 101. The driving motor 102 having the control signal received thus rotates the motor shaft 101.

The gear unit 110 (See FIG. 3) receives rotation force from the motor shaft 101 and is operated to generate a torque greater than spring force of the torsion spring coupled to the interlocking gear 210.

For an example, if it is assumed that a torque required for the gear unit 110 to move up/down the valve unit is T1, a torque of the torsion spring is T2, there is a related of T1>T2.

Because it is required that the torque transmitted to the interlocking gear 210 through the gear unit 110 is greater than spring force of the torsion spring for making secure rotation regardless of the spring force of the torsion spring.

While rotating in the same direction with a rotation direction of the motor shaft 101, the interlocking gear 210 (See FIG. 4) rotates the second spur gear 130 in an arrow direction. As the rack gear 300 engaged with the second spur gear 130 moves downward, a whole valve unit 400 moves along a moving direction of the rod portion 300. Accordingly, the EGR port 532 is made to communicate with the exhaust gas inlet 520 and the bypass port 534 is closed.

The exhaust gas shown in thick solid lines is introduced through the exhaust gas inlet 520, and flows diffusing through the EGR port 532 of an enlarger via the valve unit 400. Since the EGR port 532 is adjacent to the EGR cooler 10, the exhaust gas is made to heat exchange with the EGR cooler while a speed of the exhaust gas is dropped.

For an example, if the exhaust gas introduced to the exhaust gas inlet 520 is in a high temperature gas state having a temperature over 400° C., the temperature of the exhaust gas drops down to around 200° C. as the exhaust gas passes through the EGR cooler 10.

The exhaust gas having the temperature dropped thus is re-supplied to the engine to make combustion for re-use of the exhaust gas and minimizing discharge of nitrogen oxide.

The valve return member will be described in association of above operation.

The valve return member 600 generates torsion only when the driving unit 100 is operated regularly, or no electric error takes place.

As the motor shaft 101 rotates, the holding portion 214 of the interlocking gear 210 rotating together with the connection shaft 120 makes the first extension 620 of the torsion spring to move to a position shown in the drawing.

At the same time with this, the torsion spring generates torsion force with the coil wound a plurality of time on the body portion 610, following movement of the first extension 620.

If power supply to the driving motor 102 stops, the torsion force stored at the torsion spring makes the first extension 620 to apply a pressure to the holding portion 214 in a counter clockwise direction, and the interlocking gear 210 which is one unit with the holding portion 214 is forcibly rotates to a position where the guide projection 712 positions.

Accordingly, as the opened EGR port 532 closes, the exhaust gas supply to the engine is blocked.

The operation of the valve unit and the valve seat will be described with reference to the drawings.

The valve unit 400 is operative in the valve housing while having a pressure of the exhaust gas applied thereto as it is. When the valve unit 400 moves up/down while making surface to surface contact with an outside surfaces of the valve seats 540, friction takes place at the outside surfaces of the valve unit 400 and at the outside surfaces of the valve seats 540, respectively.

Since both the valve plates 410 and 411 of the valve unit 400 and the valve seats 540 are formed of stainless steel, wear down thereof is suppressed to the maximum even in a condition the above friction takes place.

Since the springs 420 mounted between the valve plates 410 and 411 always support the valve plates 410 and 411 toward the valve seats 540 elastically, a close contact state is maintained securely between the valve seats 540 and the valve plates 410 and 411.

The operation of the sensor unit mounted to the EGR valve of the present invention will be described with reference to the drawing attached hereto.

Referring to FIG. 6, the sensor unit 810 is arranged over the interlocking gear 210 having the magnets 212 arranged thereto.

If the interlocking gear 210 rotates in a clockwise direction or a counter clockwise direction following rotation of the motor shaft 101 which is coupled thereto, the sensor unit 810 which is a hole sensor senses magnetic flux density generated at the magnets of N poles and S poles and transmits to the control unit 800.

The control unit 800, having positions values of the valve unit 400 on different magnetic flux densities mapped thereon, can detect an accurate position of the valve unit 400 come from an amount of rotation of the rotation shaft 101 according to the magnetic flux density received at the control unit 800 from the sensor unit 810.

Accordingly, an opening of the valve unit is linearly controlled according to a flow rate of the exhaust gas.

A case when the engine is operated in a cold weather will be described with reference to the drawing attached hereto.

Figure 13:
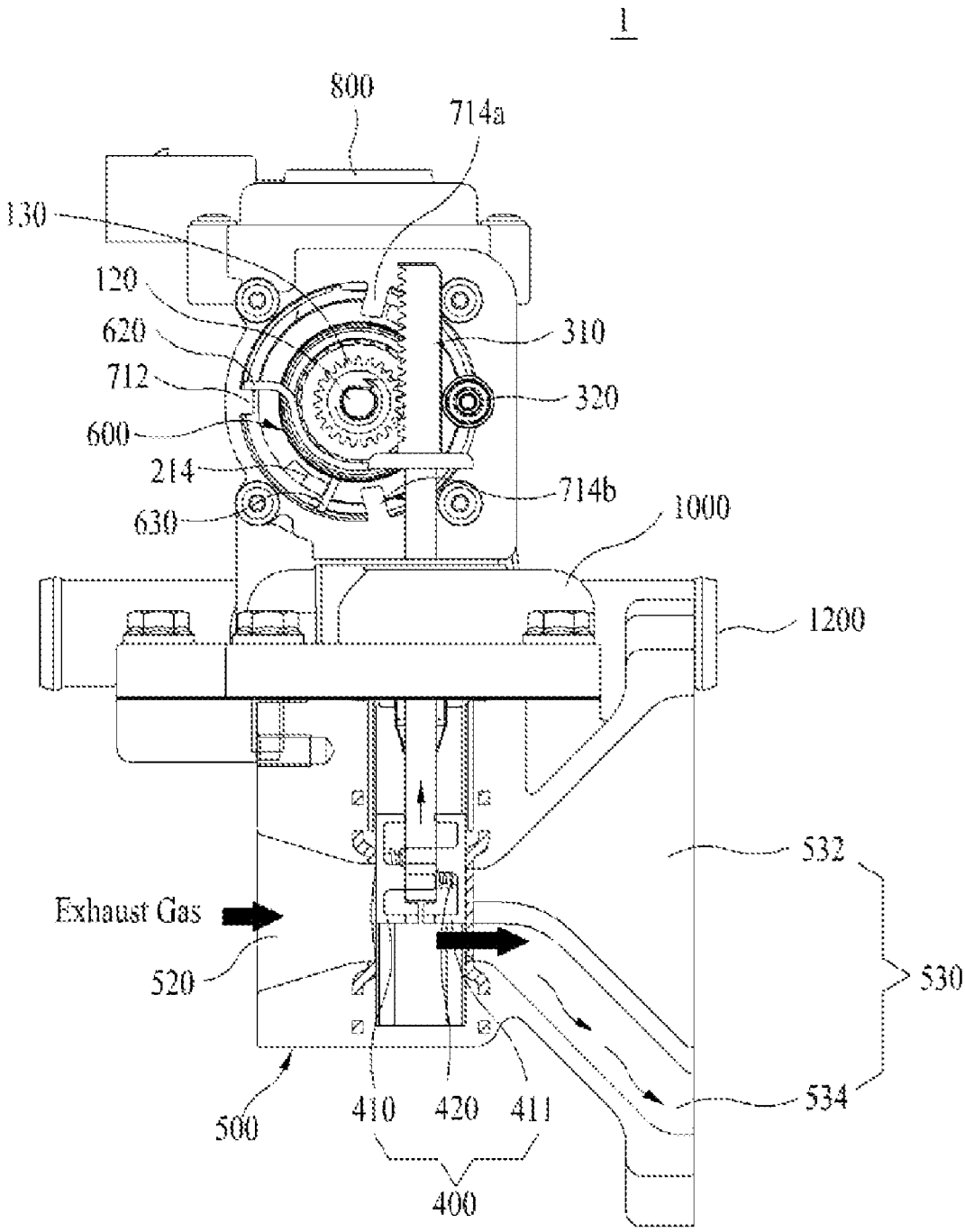

Referring to FIG. 13, if the vehicle is positioned in a polar region, or used in a subzero temperature like winter season, the EGR valve is operative as follows.

In a case the engine is operated in a low temperature state, a predetermined time period is required for the engine to reach to a temperature at which the engine can make stable operate. In a low temperature state of the engine, combustion is made as the fuel and fresh air supplied from an outside of the engine mixed together, and the exhaust gas discharged from the engine contains a relatively small amount of nitrogen oxide NOx. Therefore, the exhaust gas is not supplied to the engine, but is moved to the engine through the bypass port 543.

The control unit 800 transmits a control signal to the driving motor 102 such that the motor shaft 101 of the driving motor 102 rotates. The driving motor 102 rotates the motor shaft 101 upon reception of the control signal from the control unit 800 for rotating the connection shaft 120.

The interlocking gear 210 coupled to the connection shaft 120 rotates the second spur gear 130 while rotating in a direction the same with the rotation direction of the motor shaft 101.

As the rack gear 300 engaged with the second spur gear 130 moves upward in a direction of an arrow, the whole valve unit 400 moves following a moving direction of the rod portion 300.

Accordingly, the bypass port 534 is made to be in communication with the exhaust gas inlet 520, and the EGR port 532 is closed.

As shown in the drawing, the exhaust gas is introduced through the exhaust gas inlet 520, supplied through the bypass port 534, and introduced to the engine again. In a case the exhaust gas is supplied to the engine without being passed through the EGR cooler, a temperature of the engine rises rapidly enough to operate the engine in a state in which reduction of the nitrogen oxide is possible.

The valve return member in above operation will be described.

As described before, if the motor shaft 101 rotates, the second extension 630 of the valve return member 600 is made to return to a position shown in the drawing by the holding portion 214 of the interlocking gear 210 rotating with the connection shaft 120.

At the same time with this, the torsion spring generates and stores torsional force at the coil wound a plurality of times on the body portion 610 as the second extension moves.

If power supply to the driving motor 102 stops, the torsion force stored at the torsion spring makes the second extension 630 to apply a pressure to the holding portion 214, and the interlocking gear 210 which is one unit with the holding portion 214 is forcibly rotated to a position where the guide projection 712 positions.

Accordingly, as the bypass port 532 closes, the exhaust gas supply to the engine is blocked, securely.

A state of heat discharge from the EGR valve of the present invention will be described with reference to the drawing attached hereto.

Figure 14:
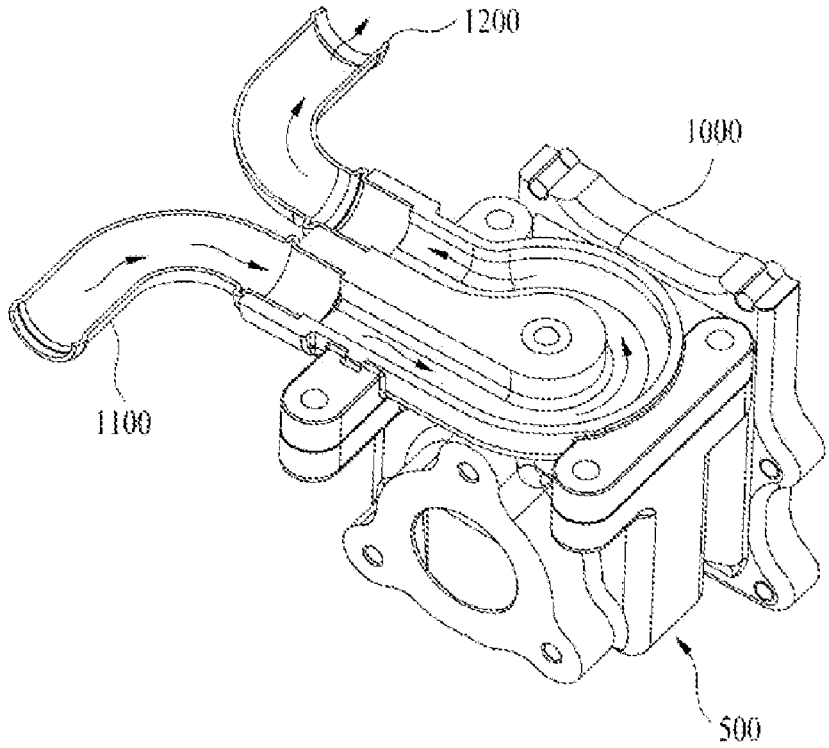
FIG. 14 illustrates an operation state in which cooling water in/out through a heat discharge unit in an EGR valve in a vehicle in accordance with a preferred embodiment of the present invention.

Referring to FIG. 14, at the time the exhaust gas is introduced to the valve housing 500, the exhaust gas has a temperature as high as over 400°.

In order to prevent the control unit 800 or the driving motor 102 from damaging burnt by the high temperature exhaust gas, the heat discharge unit 1000 is arranged on an upper side of the valve housing 500.

At the same time with starting of operation of the EGR valve 1, the heat discharge unit 1000 has the cooling water supplied thereto through the inlet pipe 1100. The cooling water may be a portion of the cooling water being supplied to the engine or a separate cooling water supply source may be provided for supply to the heat discharge unit 1000.

Once the cooling water is supplied through the inlet pipe 1100, the valve housing 500 heated by the exhaust gas heat exchanges with the cooling water. Since the valve housing 500 is formed of aluminum, though the valve housing 500 is involved in temperature rise due to the high temperature exhaust gas, as the cooling water heat exchanges with the high temperature exhaust gas while flowing throughout an entire upper surface of the valve housing 500, the temperature of the exhaust gas drops.

Accordingly, heat transfer to the driving motor 102 or the control unit 800 can be cut off, securely.

After heat exchange via the inlet pipe 1100, the cooling water moves to a radiator (not shown) or a separate cooling water tank through the outlet pipe 1200.

The operation of the valve return member at the time of an error taken place will be described with reference to the drawings attached hereto.

Figure 15:
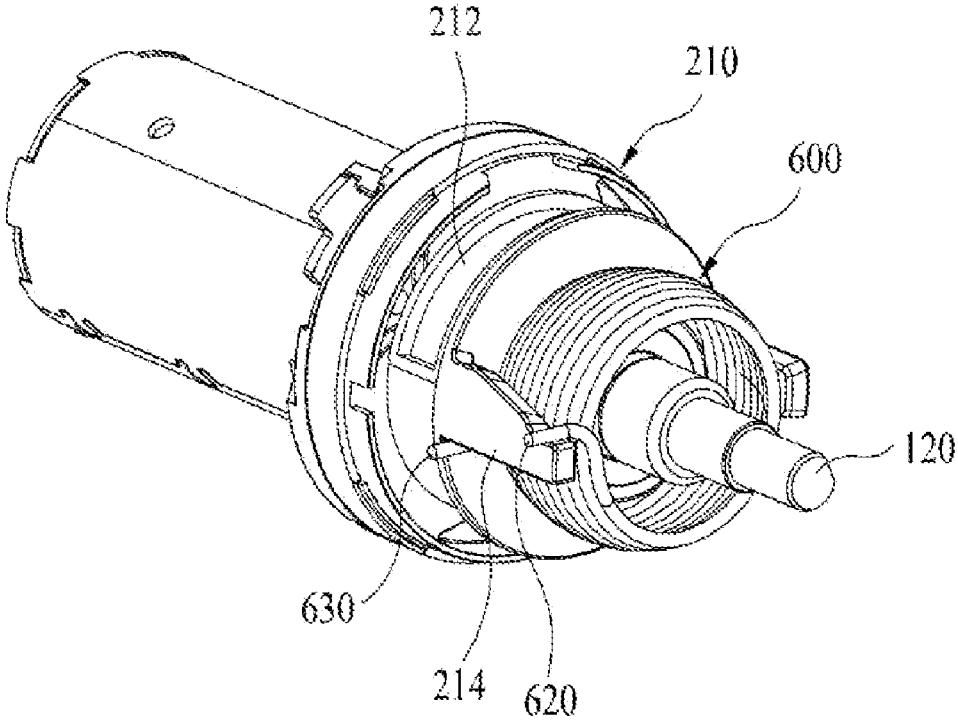
FIG. 15 illustrates a perspective view of a valve return member and an interlocking gear in an EGR valve in a vehicle in accordance with a preferred embodiment of the present invention.
Figure 16:
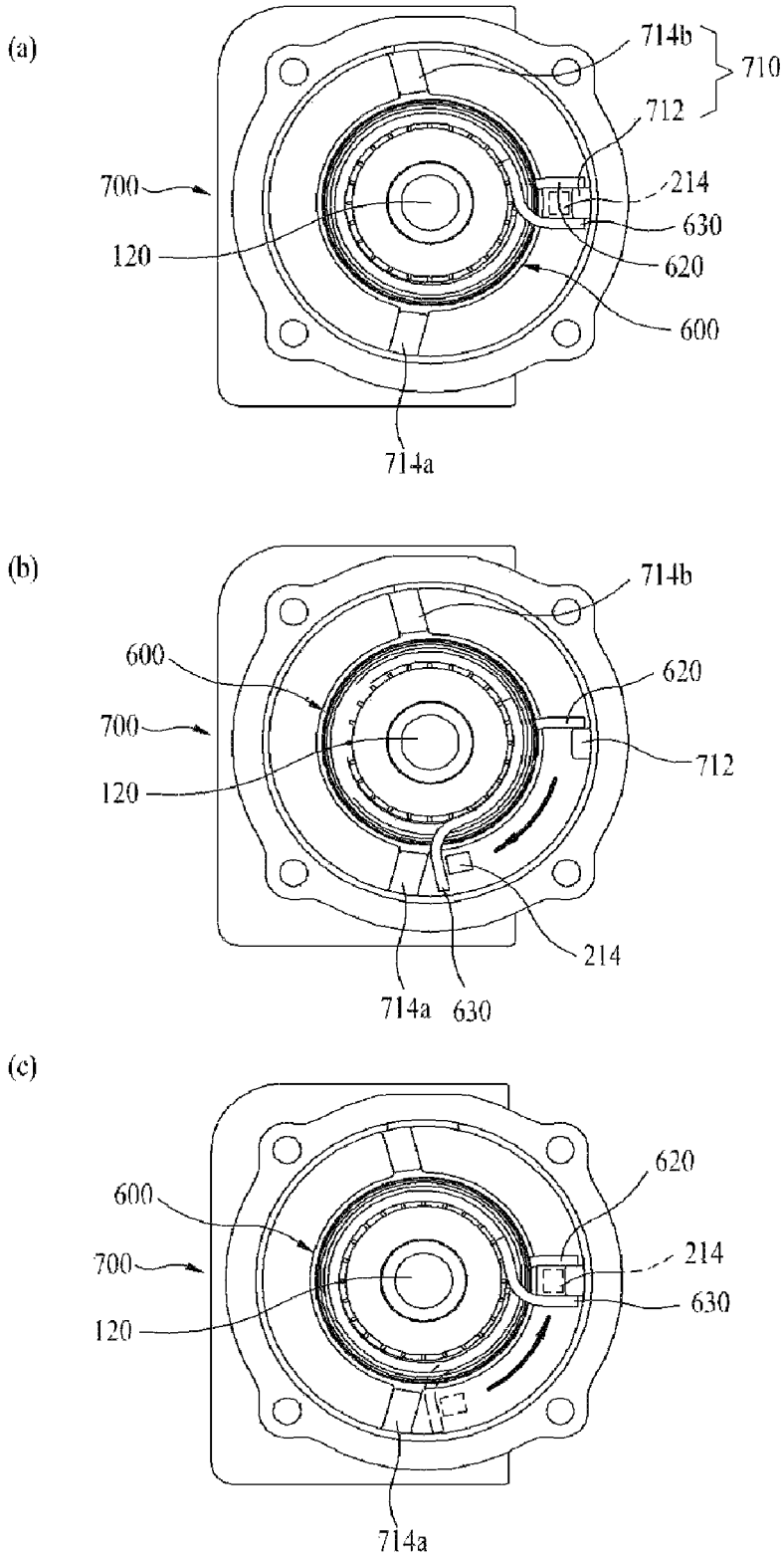
FIG. 16 illustrates an operation state of a valve return member in an EGR valve in a vehicle in accordance with a preferred embodiment of the present invention.

Referring to FIGS. 15 and 16, for an example, the error takes place when a battery which supplies power to the EGR valve is out of order, or out of order of, or a key off state of, the driving motor.

For an example, since supply of the exhaust gas to the engine is not required in a case the engine is in a turned off state in a vehicle stationary state, both the EGR port and the bypass port are closed by the valve unit.

In this instance, the control unit provides no operational signal to the driving motor, and the motor shaft at the driving motor also does not rotate the gear unit and the connection shaft.

In above state, the torsion spring maintains a state in which opposite sides of the guide projection 712 are supported by the first and second extensions 620 and 630.

In above state, even in a case the exhaust gas is introduced through the exhaust gas inlet, the exhaust gas flows neither to the EGR port nor to the bypass port owing to the valve unit.

Referring to FIG. 16 attached hereto, the torsion spring which is the valve return member 600 is a spring which is twisted in both directions. As one of the first extension 620 and the second extension 630 is rotated by the holding portion 214 of the interlocking gear 210 while the other one is supported by the guide projection 712 elastically, the body portion 610 stores torsional power.

Referring to a FIG. 16A state attached hereto, the first and second extensions 620 and 630 are positioned in a state supported by the guide projection 712, elastically.

If the motor shaft rotates (a FIG. 16B state) under this state, the holding portion 214 of the interlocking gear 210 presses the first extension 620 to move the first extension 620 to a state shown in the drawing. At the same time with this, as the second extension 630 of the torsion spring is supported by the guide portion 712 elastically, the body portion 610 of the torsion spring generates torsional power.

In a case the error takes place in an above state, the torsion spring acts as follows.

Referring to a FIG. 16C state, for an example, if transmission of torque to the connection shaft 120 fails due to out of order of the driving motor 102, the torsion power stored in the torsion spring makes the first extension 620 to move the first extension 620 from a dashed line position to a solid line position on the drawing while pressing the holding portion 214, forcibly.

If the motor shaft rotates (a FIG. 16B state) under this state, the holding portion 214 of the interlocking gear 210 presses the first extension 620 to move to a state shown on the drawing. At the same time with this, as the second extension 630 of the torsion spring is supported by the guide projection 712 elastically, the body portion 610 of the torsion spring generates torsional power.

In a case the error takes place in this state, the torsion spring acts as follows.

Referring to a FIG. 16C state, for an example, in a case transmission of the torque to the connection shaft 120 fails due to out of order of the driving motor 102, the torsional power stored in the torsion spring makes the first extension 620 to move from a dashed line position to a solid line position on the drawing forcibly while applying a pressure to the holding portion 214.

Since the holding portion 214 is formed as one unit with the interlocking gear 210, the holding portion 214 rotates the motor shaft 101 forcibly, making the valve unit to move to an initial position.

The EGR valve of the present invention and a control state thereof in relation to the control unit will be described with reference to the drawings attached hereto.

Before starting description, thin solid lines denote air flows, thick solid lines denote exhaust gas flows, and dashed lines denote signal flows.

Figure 17:
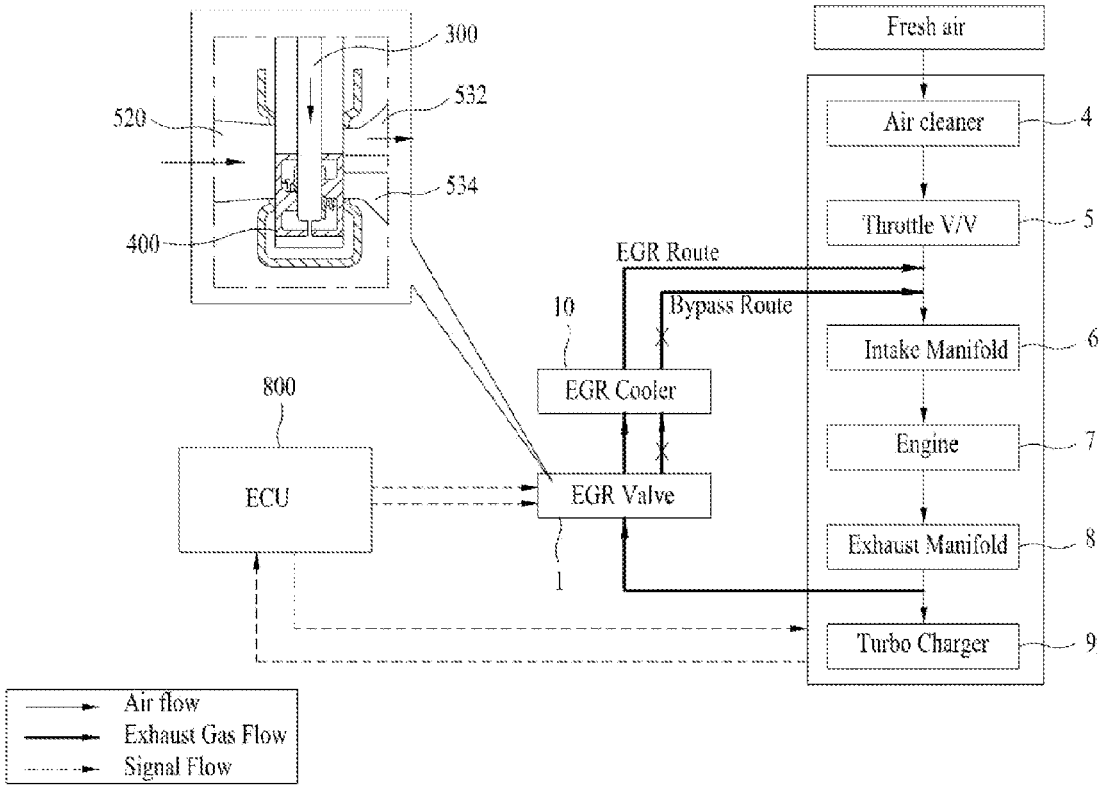
Figure 18:
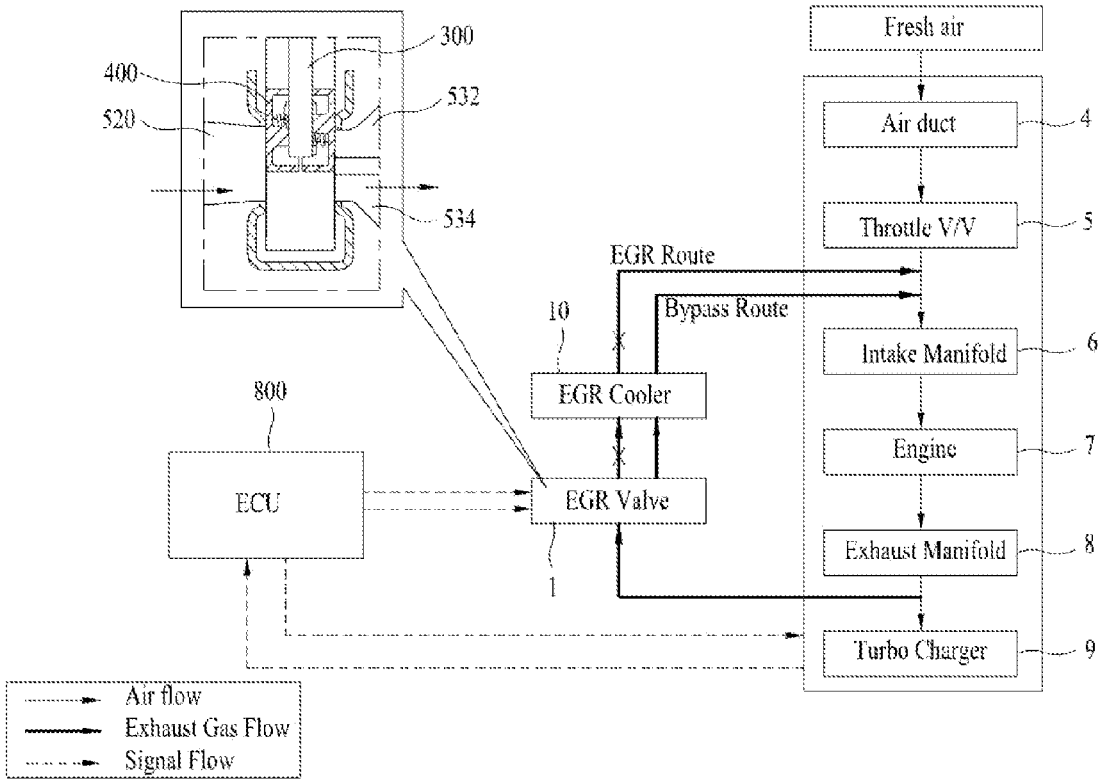

Referring to FIG. 17, in a case the vehicle is in a key off state before the vehicle is turned on, the control unit 800 controls the valve unit 400 to close both the EGR port 532 and the bypass port 534.

Though the embodiment describes that the control unit 800 is mounted to the EGR valve 1, it is apparent that a unified control unit (not shown) that controls other electronic units and/or driving sources in the vehicle can control the EGR valve.

Once a driver turns on the vehicle to run the vehicle, the control unit 800 receives rpm of the engine, a torque state, an exhaust gas temperature, a cooling water temperature, a fresh air flow rate and intake air/exhaust gas temperatures.

The fresh air is introduced through an air duct and supplied to an air cleaner 4. An air filter mounted to the air cleaner 4 filters dust and foreign matters from the fresh air.

The fresh air is supplied to the engine 7 through a throttle valve 5 and an air intake manifold 6. As the fresh air and fuel are mixed in the engine 7, combustion is made in the engine at a high temperature, and the exhaust gas produced in the combustion is supplied to the turbocharger through the exhaust gas manifold 8, and discharged to an outside of the engine through a muffler (not shown).

A portion of the exhaust gas supplied to the EGR valve before the exhaust gas is supplied to the turbocharger 9 from the exhaust gas manifold 8 is introduced thereto through the exhaust gas inlet 520. The exhaust gas is in a gas state having a temperature over 400° C.

The control unit 800 transmits control signals to the turbocharger 9 and the EGR valve 1.

The control unit 800 determines whether the exhaust gas is supplied to the EGR valve 1 or not upon reception of a signal from the turbocharger 9.

If it is necessary to supply the exhaust gas to the EGR valve 1, the control unit 800 transmits a control signal to the driving motor 102 to make the exhaust gas to flow through the EGR port 532.

The motor shaft 101 on the driving motor 102 is rotated by a predetermined angle by the control unit 800, making the valve unit 400 to move through the gear unit 110 engaged with the motor shaft 101 and the connection shaft 120, permitting the exhaust gas to be transferred to the intake manifold 6 and therefrom to be supplied to the engine 7 again. In this instance, since the bypass port 534 is in a closed state, no exhaust gas is supplied as shown in the drawing.

A case when the engine is started in a cold environment (a cold starting state) will be described with reference to the drawing attached hereto.

Referring to FIG. 17, the control unit 800 receives signals of the exhaust gas temperature being discharged to an outside of the turbocharger 9 and the cooling water temperature.

In the cold starting state of the engine, when the engine is in a state a normal operation temperature of the engine is not reached yet, the control unit 800 receives the cooling water temperature which is low.

Determining this, the control unit 800 controls the rod portion 300 to move upward so that the EGR valve 1 is operated in the cold starting state.

At the EGR valve 1, the exhaust gas can not be supplied to the EGR port 532 by the valve unit 400, but is supplied to the bypass port 534 and therefrom to the engine 7.

An operation state of the control unit in a key off or an error state will be described.

Figure 19:
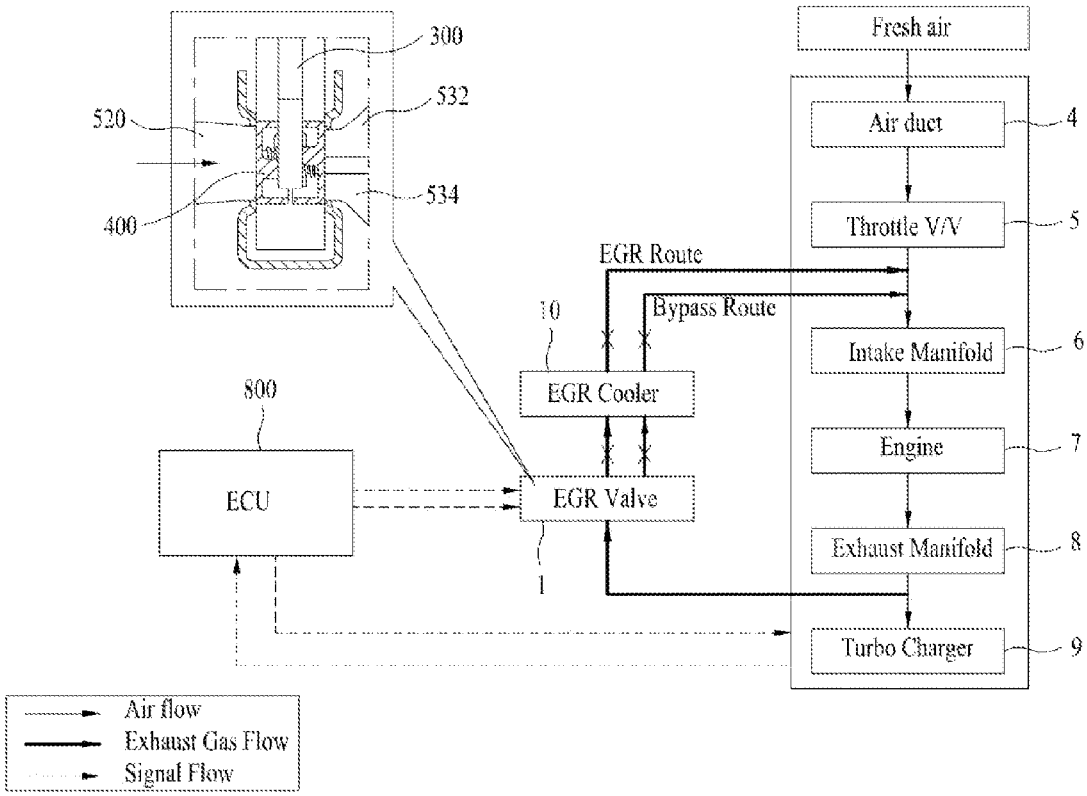

Referring to FIG. 19 attached hereto, the control unit 800 receives rpm of the engine, the exhaust gas temperature and the cooling water temperature.

If the engine is in the key off state, the engine is turned off state, and if it is determined that the exhaust gas temperature is low, the control unit 800 controls the valve unit 400 to close both the EGR port 532 and the bypass port 534. In above state, the exhaust gas is not supplied to the engine 7.

As described before, in a case the error takes place suddenly in middle of regular operation, the torsional power of the torsion spring moves the valve to the initial position to close both the EGR port 532 and the bypass port 534.

The linear operation state of the EGR valve of the present invention will be described with reference to the drawings attached hereto.

Figure 20:
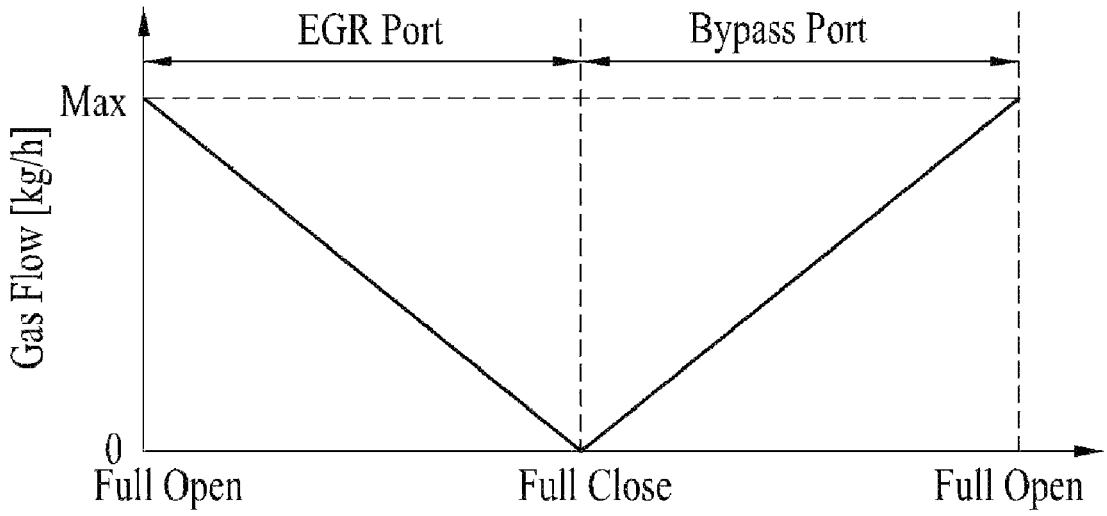
FIGS. 20 and 21 illustrate graphs showing an exhaust gas flow rate vs. a valve opening in EGR valves in a related art and in accordance with the present invention, respectively.
Figure 21:
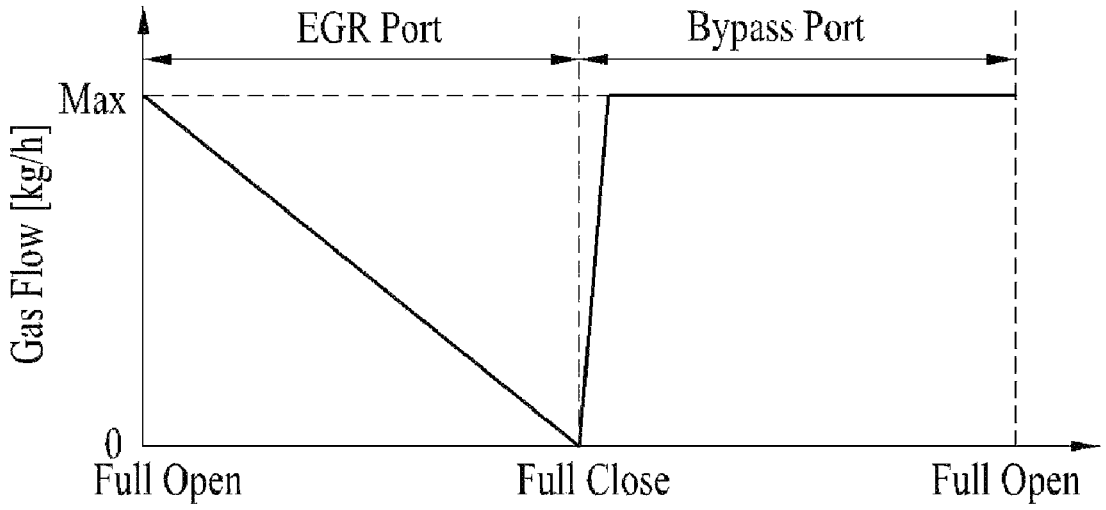

FIG. 20 illustrates an operation state of the EGR valves in accordance with a preferred embodiment of the present invention, and FIG. 21 illustrates an operation state in a state a related art EGR valve and a related art bypass valve are mounted, individually. An X-axis denotes an opening of the valve and a Y-axis denotes a flow rate.

It is verified that the EGR valve of the present invention has a linear locus of a flow rate of the exhaust gas according to the opening of the valve unit, and particularly, it can be known that the greater the opening of the valve unit at the bypass port, the greater the flow rate of the exhaust gas in a linear fashion in proportion to the opening.

Referring to FIG. 21, since the related art EGR valve has sudden increase of the flow rate of the exhaust gas up to a maximum value at the time of opening of the valve at the bypass port, making a non-uniform exhaust gas flow, the linear state flow rate control like the EGR valve of the present invention is failed, and a non-linear flow rate control is made.

As has been described, the exhaust gas recirculation valve of the present invention has the following advantages.

The EGR valve in a vehicle of the present invention enables to improve controllability and to minimize emission of harmful gas.

The EGR valve in a vehicle of the present invention enables to simplify layout when the EGR valve is mounted to the vehicle, and to make easy countermeasure to various running environment, thereby improving engine combustion efficiency.

The EGR valve in a vehicle of the present invention enables regular operation and running of the engine even in a case an error takes place at the vehicle.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An exhaust gas recirculation EGR valve in a vehicle comprising:

a driving unit having a driving motor for rotating a motor shaft;

an interlocking unit for receiving rotation force from the motor shaft;

a rod portion arranged perpendicular to the interlocking unit for moving upon reception of the rotation force from the interlocking unit;

a valve unit provided to an end portion of the rod portion for controlling a flow rate of the exhaust gas; and a valve housing coupled to the driving unit as one unit, having an EGR port and a bypass port, wherein:

the interlocking unit includes a valve return member for rotating the motor shaft forcibly to make the valve unit to move to an initial position;

the valve return member is a torsion spring which generates torsion in a rotation direction of a regular or reverse direction rotation of the motor shaft the torsion spring including a body portion having a coil wound plurality of times, and first and second extensions from a starting point and an end point of the coil wound thus, respectively;

the interlocking unit further includes a cap member which covers an outside, and the valve return member is mounted in the cap member;

the cap member includes a projection from an inside surface thereof; and the projection includes:

a guide projection for supporting the first and second extensions of the torsion spring; and a stopper is arranged spaced from the guide projection to prevent the interlocking gear from rotating excessively.

2. The EGR valve as claimed in claim 1, wherein the interlocking unit further includes an interlocking gear for rotating the valve return member in a circumference direction interlocked with rotation of the motor.

3. The EGR valve as claimed in claim 2, wherein the interlocking gear has magnets arranged in a section of a circumferential surface thereof.

4. The EGR valve as claimed in claim 1, wherein the valve housing includes;

a passage having a vertical opening for enabling the valve unit to move up/down, an exhaust gas inlet arranged to cross the passage perpendicular to a direction of the opening for introduction of the exhaust gas therethrough, and an exhaust gas outlet arranged on the same line with the exhaust gas inlet, wherein the exhaust gas outlet has an EGR port of an enlarger arranged thereto, which has a diameter that becomes the greater as the exhaust gas outlet goes to an outside the more, and a bypass port which is partitioned from the EGR port and an outward extension having the same diameter.

5. The EGR valve as claimed in claim 4, wherein the valve housing includes valve seats provided at positions where the exhaust gas inlet and the exhaust gas outlet cross with the passage for guiding movement of the valve unit, respectively.

6. The EGR valve as claimed in claim 1, wherein the valve unit includes;

one pair of valve plates fixedly secured to an end portion of the rod portion opposite to each other, and springs arranged between the valve plates.

7. The EGR valve as claimed in claim 6, wherein the springs always support the valve plates outwardly elastically such that the valve plates supporting the valve plates outwardly elastically thus are arranged to be in close contact with the valve housing to seal between the valve plates and the valve housing.

8. The EGR valve as claimed in claim 1, wherein the valve unit includes a chamber on a lower side for holding foreign matters from the exhaust gas while the valve plates move up/down.

9. The EGR valve as claimed in claim 1, further comprising a control unit arranged adjacent to the driving unit for supplying power to, and controlling operation of, the driving unit, and receives rpm of the engine, a torque state, an exhaust gas temperature, and a cooling water temperature for controlling the driving unit.

10. The EGR valve as claimed in claim 9, wherein the control unit includes a sensor unit for sensing magnetic flux density of magnets provided to the interlocking gear when the motor shaft rotates.

11. The EGR valve as claimed in claim 1, further comprising a gasket between the driving unit and the valve housing for cutting off conduction of the high temperature exhaust gas and heat to the control unit.

12. The EGR valve as claimed in claim 1, further comprising a heat discharge unit between the driving unit and the valve housing through which the cooling water flows for preventing heat of the high temperature exhaust gas from transmitting to the control unit.

* * * * *